US006000071A

United States Patent [19]

Fettes

[11] Patent Number: 6,000,071

[45] Date of Patent: Dec. 14, 1999

[54] SPA COVER LIFT SYSTEM

[76] Inventor: Ian J. Fettes, 2412 Holly La., Newport Beach, Calif. 92663

[21] Appl. No.: 08/985,076

[22] Filed: Dec. 4, 1997

[51] Int. Cl.[6] ..... E04H 4/00

[52] U.S. Cl. ..... 4/498; 4/503; 49/386

[58] Field of Search ..... 4/496, 498, 503, 4/580; 49/386; 220/264, 810, 831, 832

[56] References Cited

U.S. PATENT DOCUMENTS

| | | | |
|---|---|---|---|
| 1,686,511 | 10/1928 | Blakeslee | 220/832 |
| 3,516,095 | 6/1970 | Clifton et al. | 4/251 |
| 3,567,062 | 3/1971 | Reed et al. | 220/832 |
| 3,896,595 | 7/1975 | Anghinetti et al. | 52/19 |
| 4,208,840 | 6/1980 | Jentoft et al. | 49/379 |
| 4,853,985 | 8/1989 | Perry | 4/498 |
| 4,857,374 | 8/1989 | Perry | 428/71 |
| 4,899,420 | 2/1990 | Bye et al. | 16/1 C |
| 4,991,238 | 2/1991 | Forrest | 4/498 |
| 5,048,153 | 9/1991 | Wall et al. | 4/498 |
| 5,086,525 | 2/1992 | Christopher | 4/498 |
| 5,131,102 | 7/1992 | Salley et al. | 4/498 |
| 5,517,703 | 5/1996 | Ouelette | 4/498 |
| 5,566,403 | 10/1996 | Black et al. | 4/498 |
| 5,819,332 | 10/1998 | Perry | 4/498 |

*Primary Examiner*—Charles R. Eloshway
*Attorney, Agent, or Firm*—Larry K. Roberts

[57] ABSTRACT

Apparatus for aiding removal and replacement of a spa cover. The apparatus includes at least one lifting assembly secured relative to the spa tub, each having a lifting arm mounted for rotation relative to the spa tub and including a cover-engaging end coupled to the spa cover and a pivot end mounted for pivotal movement about a pivot axis. The lifting arm is rotatable through a range of motion about the pivot axis between a covering position and an uncovering position. A lifting system is provided for exerting a lifting force on the arm tending to lift the arm as the arm moves from the covering position toward the uncovering position, and for exerting a resistance force on the arm tending to resist movement of the arm from the uncovering position toward the covering position. The lifting system includes a link lever having a pivot end pivotally mounted to the lift arm at a link pivot location disposed between the arm pivot end and the cover-engaging end. A slider end of the link lever is constrained for sliding movement along a slider path of travel. A spring structure is connected to the link lever at a spring pivot location between the link lever pivot end and the slider end. The spring structure is also connected to the lift arm at a spring connection point, and is under compression when the lift arm is at the covering location.

28 Claims, 11 Drawing Sheets

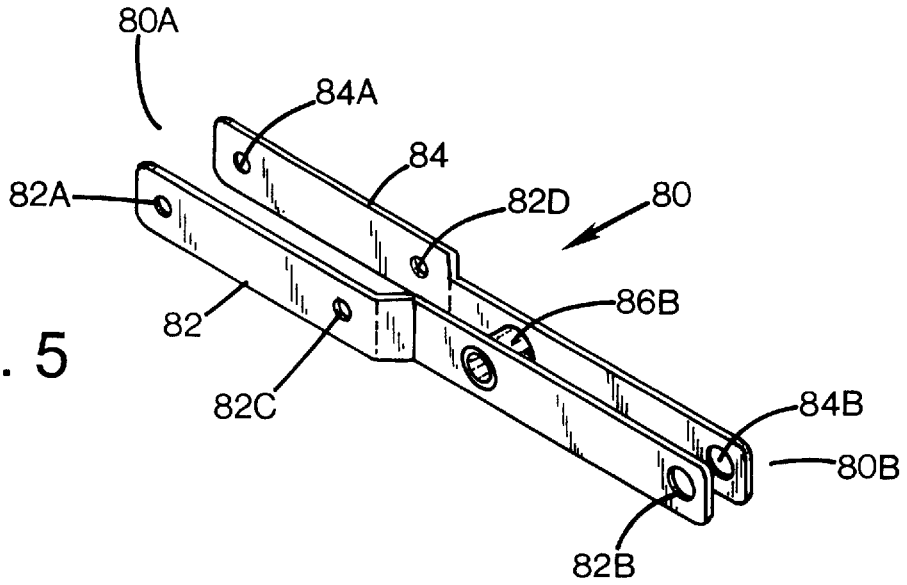
FIG. 5
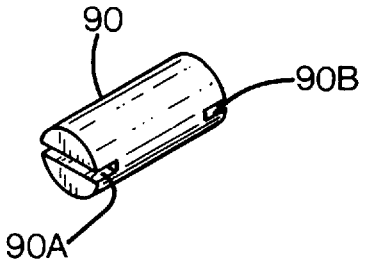
FIG. 6
FIG. 7
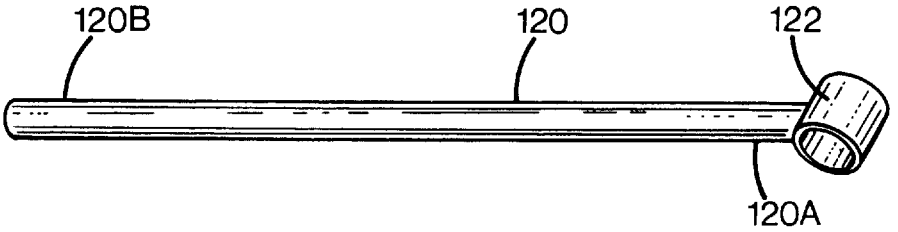

SPA COVER LIFT SYSTEM

TECHNICAL FIELD OF THE INVENTION

The present invention relates to a spa cover lift system for aiding a user in moving a spa cover between open and closed positions.

BACKGROUND OF THE INVENTION

Residential spas are widespread sources of enjoyment and relaxation. Such spas are typically formed with dimensions several feet on a side. Spas may be located in the ground, within a gazebo, or surrounded by a deck. They are preferably covered when not in use both to maintain water temperature and to prevent contamination of the spa water. Spa covers typically employ a rigid frame across which a cover of wood, fabric, or plastic is spread.

Due to its considerable mass, a spa cover mounted on a conventional mounting system is quite heavy to lift from a closed position into an open position. Considerable strength is required to lift the spa cover through an arc of ninety degrees in moving it to cover and uncover the spa tub. At present there are various assist mechanisms available for moving a spa cover between open and closed positions. Conventional spa covers, when moved from a position covering the spa into an open position, are sometimes mounted on hinge mechanisms which allow the spa covers to be rotated between a generally horizontal orientation above the surface of the spa and a generally vertical orientation extending upwardly along one edge of the spa deck.

U.S. Pat. No. 5,566,403 describes a spa cover lift apparatus, which uses gas springs to aid in the lifting process. The described apparatus is susceptible to damage to the gas springs due to overstretching the spring with the cover in the upright position. With the cover in the upright position, forces due to wind gusts or improper use can tend to rotate the cover past the upright position, placing a stretching force on the gas spring. This can cause failure of the gas spring. Another disadvantage of the lift apparatus described in this patent is that, due to the pivotal connection of the spring to the lifting arm and spa, the spring will exert considerable lifting force when the cover is in the closed position. This can assist the cover being opened under undesired circumstances, e.g. due to wind gusts.

It would therefore represent an advantage to provide a spa cover lift system which provides protection against overstretching the assisting spring at the upper travel limit.

It would further be an advantage to provide a spa cover lift system which provides little or no lift assistance when the spa cover is in the covered position, and which rapidly provides increased lift assistance after the cover has been lifted away from the top of the spa.

SUMMARY OF THE INVENTION

An apparatus is described for aiding removal and replacement of a spa cover on top of a spa tub. The apparatus includes at least one lifting assembly secured relative to the spa tub. Each lifting assembly has a lifting arm mounted for rotation relative to the spa tub and including a cover-engaging end coupled to the spa cover and a pivot end mounted for pivotal movement about a pivot axis. The lifting arm is rotatable through a range of motion about the pivot axis between a covering position and an uncovering position. A lifting system is provided for exerting a lifting force on the arm tending to lift the arm as the arm moves from the covering position toward the uncovering position, and for exerting a resistance force on the arm tending to resist movement of the arm from the uncovering position toward the covering position. The lifting system includes a link lever having a pivot end pivotally mounted to the lift arm at a link pivot location disposed between the arm pivot end and the cover-engaging end. A slider end of the link lever is constrained for sliding movement along a slider path of travel. The lifting system further includes a spring structure connected to the link lever at a spring pivot location between the link lever pivot end and the slider end. The spring structure is also connected to the lift arm at a spring connection point between the arm pivot end and the cover-engaging end, wherein the spring structure is under compression when the lift arm is at the covering location.

The spring structure in an exemplary embodiment is a gas spring, wherein a gas is compressed in a closed cylinder, biasing a piston toward an extended position. The spring structure includes a coupling device for coupling the spring to the lift arm in such a way as to prevent damage to the spring by over-stretching the spring as the lift arm reaches the uncovering position.

A locking system is also included to clamp the lift arm at a desired position. The clamp is intended to hold the cover open or closed, but in such a way as to be overpowered if excessive force is exerted, so that the mechanism is not damaged. Thus, for example, if the cover is in the opened position, the clamp will slip in a heavy gust of wind.

BRIEF DESCRIPTION OF THE DRAWING

These and other features and advantages of the present invention will become more apparent from the following detailed description of an exemplary embodiment thereof, as illustrated in the accompanying drawings, in which:

FIG. 5 is an isometric view of the link lever employed in the lift system.

FIG. 6 is an isometric view of the pivot pin used in the link lever of FIG. 5.

FIG. 7 is an isometric view of the clamp arm used in the device of FIG. 1.

DETAILED DESCRIPTION OF THE PREFERRED EMBODIMENT

Figure 1:
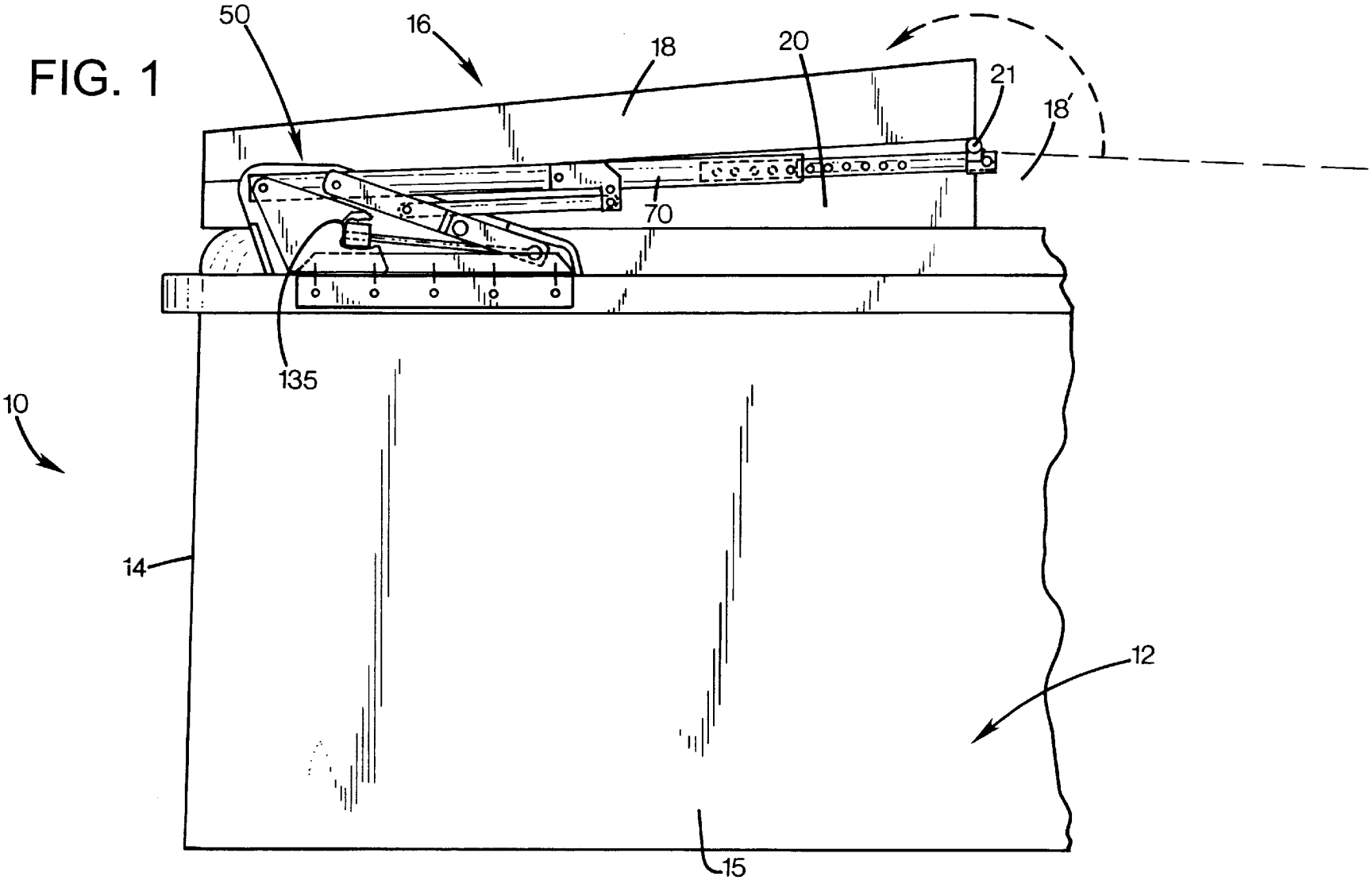
FIG. 1 is a partial side view of a conventional spa, with a spa cover lift system in accordance with the invention, and the spa cover in the covering position.

FIG. 1 shows in side view a portion of a conventional, generally rectangular spa 10, with a spa cover lift system in accordance with the invention. The spa 10 may be a prefabricated, fiberglass structure in which a concave, upwardly facing tub 12 has a generally rectangular cover 16 disposed at the top thereof. The spa cover 16 is typically formed of a thermally insulating, water insensitive material, e.g. rigid polyurethane, enclosed within a waterproof fabric casing such as vinyl plastic. The peripheral edges of the spa cover 16 are supported about the perimeter of the tub 12 by upright vertical end walls 14 and upright vertical side walls 15.

The spa cover 16 is divided longitudinally into two halves 18 and 20 which are hinged together by a transversely-extending hinge 21. The spa cover portion 18 can be unfolded from a position on top of the spa cover portion 20 to extend horizontally as indicated at 18' as shown in FIG. 1. When the spa cover portion 20 is in the horizontal covering position illustrated in FIG. 1, and the spa cover portion 18 is unfolded to extend longitudinally therefrom to the unfolded position indicated at 18', the spa cover 16 is in its completely closed position and covers the entire surface of the water within the spa tub 12. The spa cover 16 rests on the upper edges of all of the walls 14 and 15 when it is completely closed in this manner.

To open the spa cover 16 from its fully closed position, the user first folds back the spa cover portion 18 about the hinge 21 until the spa cover portion 18 rests on top of the spa cover portion 20. The spa cover 16 is shown in solid lines in FIG. 1 folded in preparation for lifting. At this point half of the water surface of the spa 10 in the tub 12 is covered while the other half is exposed.

Figure 2:
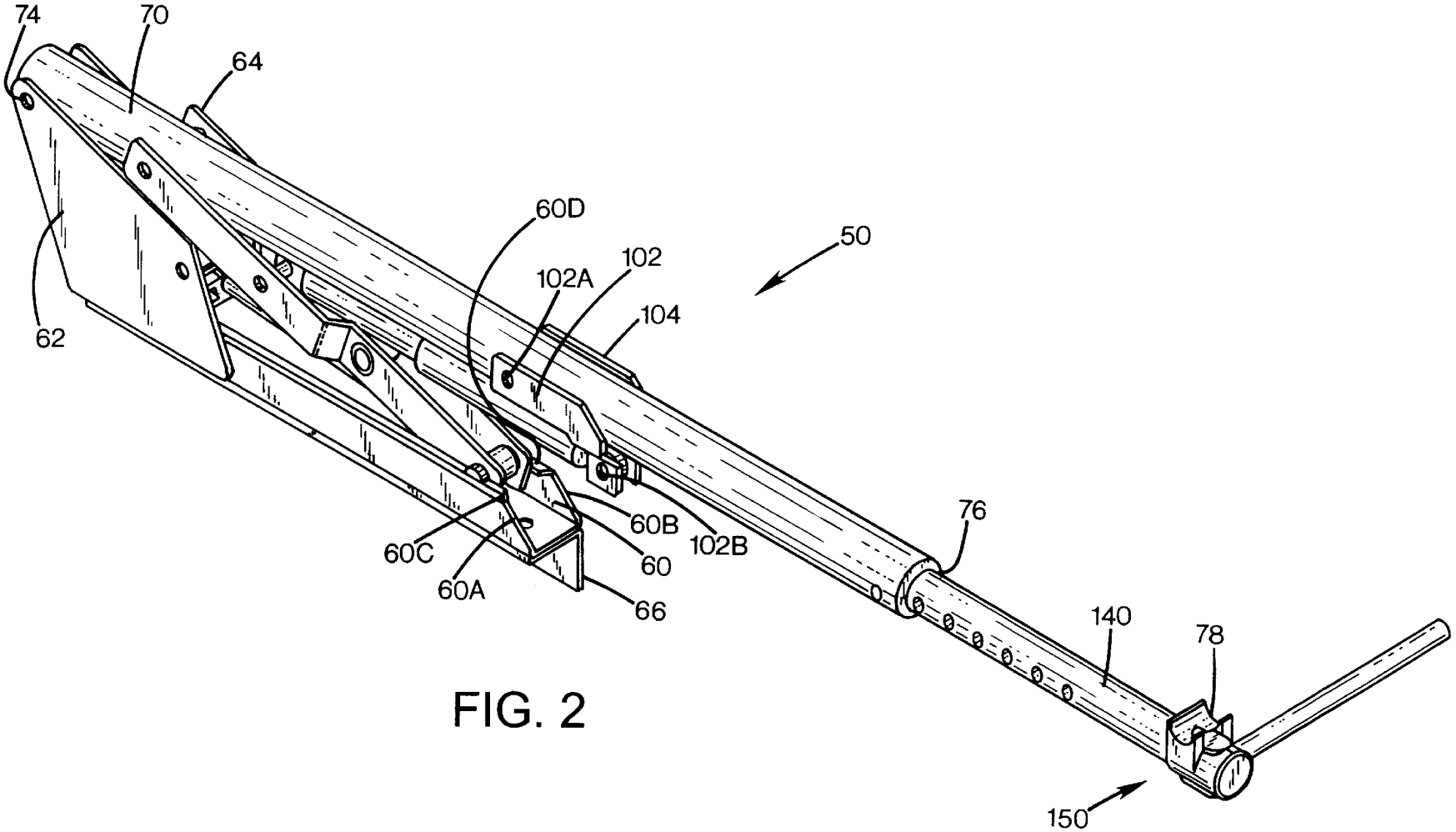
FIG. 2 is an isometric view of a lifting assembly embodying the invention.
Figure 3:
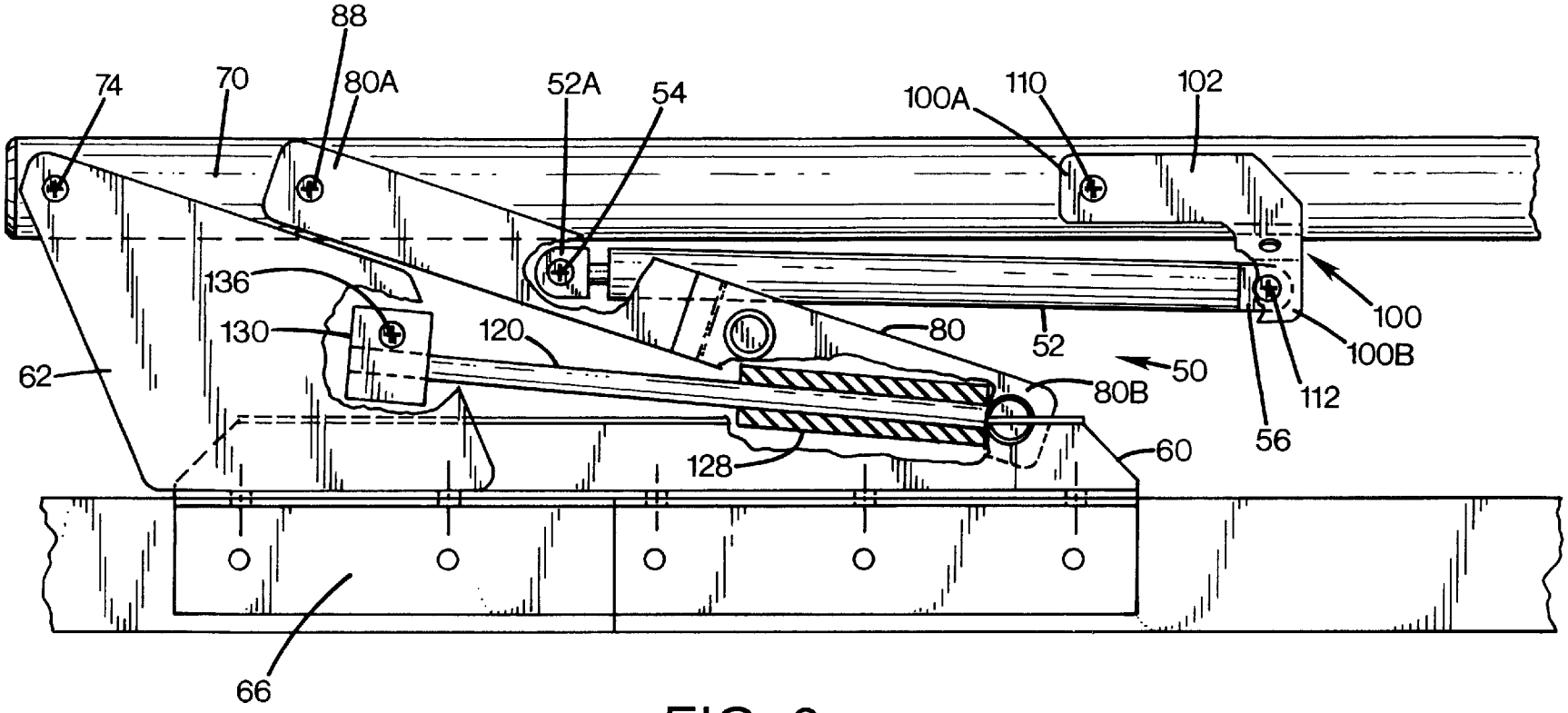
FIG. 3 is a close-up side view of the lifting assembly in position on the top edge of the spa.
Figure 4:
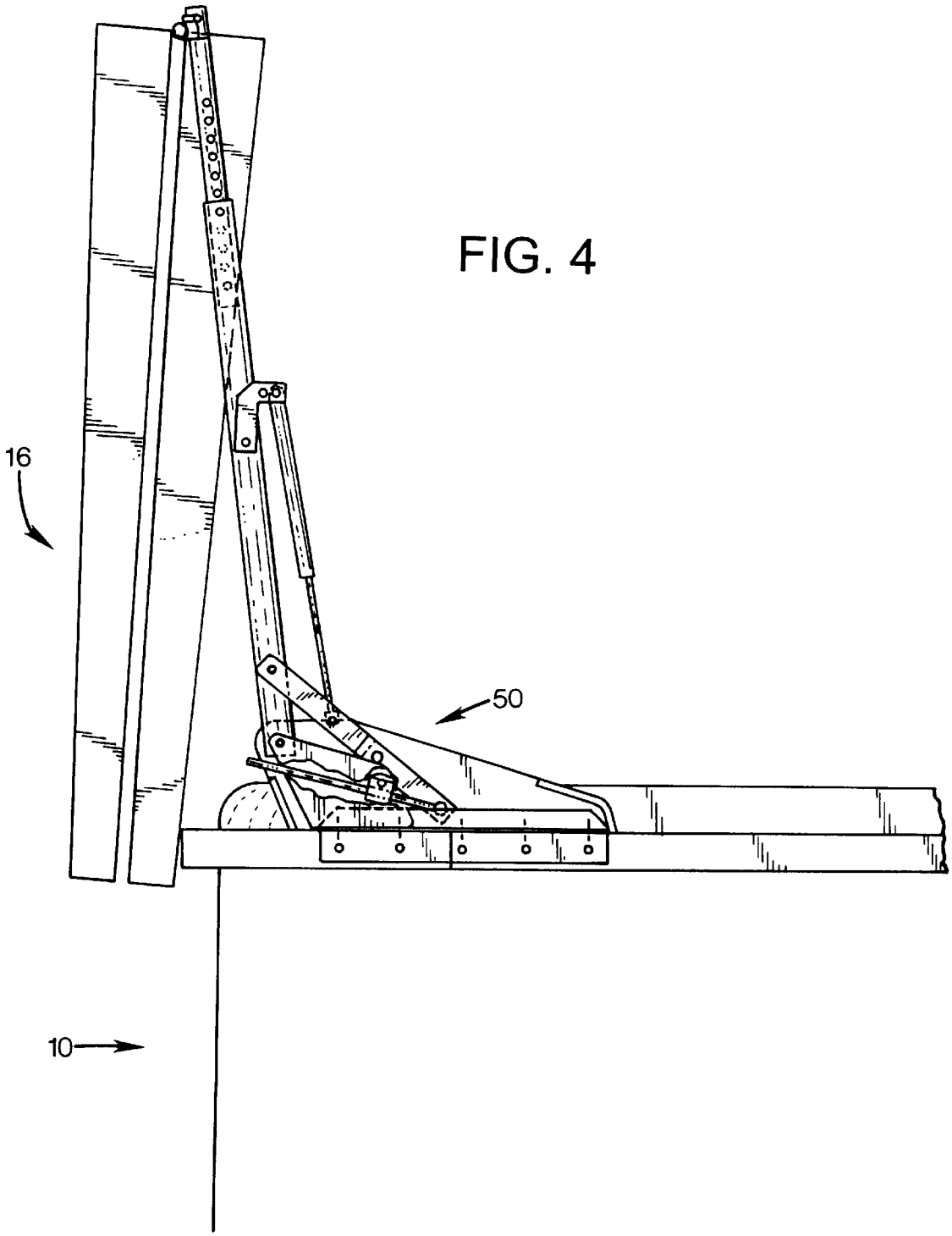
FIG. 4 is a partial side view of the spa of FIG. 1, with the spa cover shown in the uncovered position.

In accordance with an aspect of this invention, a pair of lifting assemblies 50 are secured to the top edge of the spa on opposite sides, each of which engages the spa cover to assist in opening/closing the spa cover. FIG. 2 is an isometric view of one assembly 50. FIG. 3 is a close-up side view of one assembly 50 in position on the top edge of the spa; for clarity, the spa cover is not shown in FIG. 3. The lifting assembly 50 includes a gas-pressurized cylinder or spring 52 which provides lift-assisting force to help raise the spa cover from the lower position shown in FIG. 1 to an opened position, shown in FIG. 4, wherein the spa cover is in a generally vertical orientation. The biasing moment applied by the spring 52 to the lifting arm 70 (FIG. 1) is less than the gravitational moment exerted by the spa cover 16.

As shown in FIGS. 2 and 3, the lifting assembly of this exemplary embodiment includes a channel bracket 60, and a pair of side plates 62, 64 which are secured to the outer surfaces of the bracket walls 60A and 60B adjacent one end thereof. The channel bracket 60 can be fabricated of 14 gauge steel. The side plates 62, 64 can be fabricated of 12 gauge steel. The plates 62, 64 can be secured to the bracket walls by conventional techniques, such as by welding, threaded fasteners or the like.

A right angle bracket 66 is secured to the underside of the channel bracket 60, e.g. by fasteners or by welding. The right angle bracket 66 provides a mounting structure to mount the lifting assembly to the spa by threaded fasteners which extend through holes formed in the vertical surface of the right angle bracket. Alternatively, the right angle bracket 66 can be omitted or removed, and the lifting assembly 50 secured to the top rim of the wall 15, by threaded fasteners extending through openings formed in the bottom surface of the channel bracket 60.

The side plates 62, 64 are formed in a rhomboid shape, and are spaced apart by the width of the channel bracket. Holes are formed in the elevated corner of each side plate for pivotally mounting an end of the lifting arm 70. In this exemplary embodiment, the lifting arm 70 is a hollow tubular member fabricated of 16 gauge steel. A hole is drilled through the lift arm 70 adjacent the end thereof, and the lifting arm is pivotally mounted by a pivot pin 74 which extends through corresponding holes formed in the elevated corners of each side plate and the hole formed in the lift arm 70. Bushings can be used around the pin to prevent contact between the side plates and the sides of the lifting arm. The lifting arm when secured in this fashion can be pivoted about the pin 74 through a range of motion which is sufficient to accommodate the motion needed for operation of the spa cover 16.

The lift assembly 50 further includes a link lever assembly 80 having a first end 80A pivotally mounted to the lift arm, and a second end 80B coupled to the channel bracket for sliding movement along the channel bracket as the lift arm 70 is raised and lowered about the pivot pin 74. In this exemplary embodiment, the assembly 80 includes first and second link levers 82 and 84 which are assembled together. Each lever has a pair of bends formed therein such that, when the levers are assembled as shown in FIG. 5, there is a wider gape between the lever ends at end 80A than at end 80B, this to accommodate the larger diameter of the lift arm 70. A metal spacer tube 86B is welded in place between the levers 82 and 84 to secure the two levers together. Holes 82A and 82B are formed adjacent the ends of the lever 82. Corresponding holes 84A and 84B are formed adjacent the ends of the lever 84.

The end 80A of the link lever assembly is pivotally connected to the lift arm 70 by a pin 88 which extends through the holes 82A, 84A formed in the link levers, and through a corresponding hole formed through the lift arm 70. A slider pivot pin 90, shown in detail in the isometric view of FIG. 6, fits through the holes 82B, 84B adjacent end 80B of the link lever assembly, and includes slots 90A and 90B formed in the opposed ends of the pin. These slots are sized to receive the in-turned edges 60C, 60D of the channel bracket walls, so that the ends of the pin 90 are captured by the edges 60C, 60D. The pin 90 together with the end 80B of the link lever assembly 80 are constrained for sliding movement along the channel bracket. The end 80B of the assembly can pivot about the pin 90 as the pin slides along the channel bracket. The slider pin 90 can be made of metal or a hard plastic such as DELRIN (™).

The link levers 82, 84 each have a third hole 82C, 82D respectively formed therein. These holes receive a clevis pin 54, used to mount a clevis 56 connected to end 52A of the gas cylinder 52, to the link lever assembly 80. A clevis 56 at the opposite end of the cylinder 52 is coupled to the lift arm 70 through a bracket assembly 100 comprising brackets 102 and 104. Each bracket 102 and 104 includes a hole formed adjacent each end, including holes 102A, 102B formed in bracket 102. These holes receive pivot pins 110 and 112. Pin 110 extends through corresponding holes formed in the brackets 102, 104 and through the lift arm 70, to couple end 100A of the bracket assembly to the lift arm. Pin 112 extends through corresponding holes formed in the brackets 102, 104 and through the clevis 56 to couple end 100B of the bracket assembly to the pressurized cylinder 52.

The lifting assembly 50 further includes a locking system to clamp the lifting arm 70 in a given position along its range of movement, typically in the closed or opened position. The locking system includes a clamp rod 120 having one end secured to the pin 90, and a clamp 130 for clamping the rod in a selected position. The clamp rod 120 is shown in FIG. 7, and includes a short transverse tube 122 secured at one end 120A thereof. The tube 122 has an inner diameter larger than the outer diameter of the pin 90, which fits through the tube 122. The rod end 120A then travels with the pin 90. The other rod end 120B fits through the clamp 130, which in a released state permits the rod end 120B to slide freely therethrough, allowing motion of the pin 90 and the lifting arm coupled thereto. By tightening the clamp 130, the user can clamp the rod in position within the clamp, which thereby holds the lifting arm 70 in a clamped position corresponding to the clamped position of the rod.

Figure 8A:
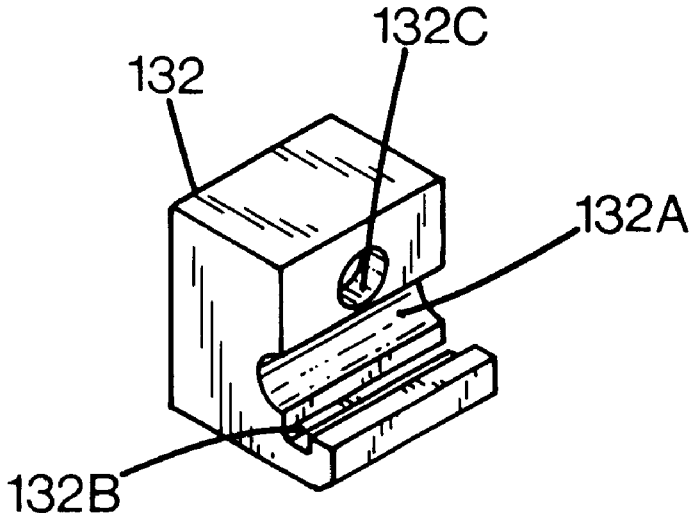
FIGS. 8A and 8B are isometric views of the outer and inner clamp elements of the invention.
Figure 8B:
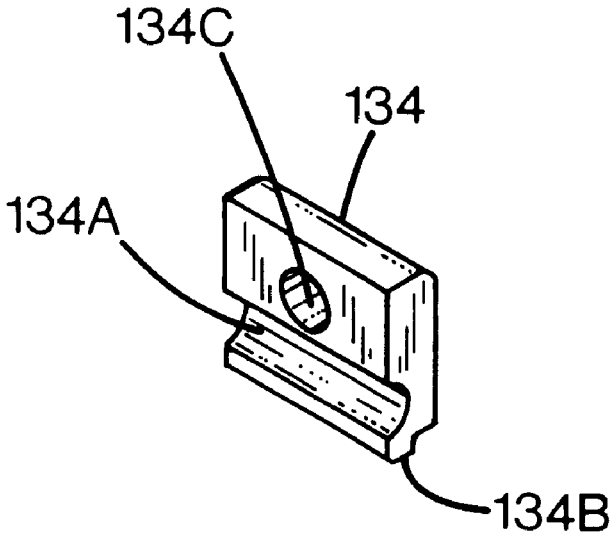

The clamp 130 includes an outer clamp element 132 (FIG. 8A) and an inner clamp element (FIG. 8B). The outer element 132 has formed therein an elongated groove 132A of generally semi-circular cross-sectional configuration which bears against the rod when the clamp is tightened, a rectilinear elongated groove 132B, and a hole 132C. The inner element 134 includes an elongated groove 134A of generally semi-circular cross-sectional configuration which bears against the rod when the clamp is tightened, an elongated tab 134B which fits into groove 132B of the outer element 132, and a threaded bore 134C for receiving the threaded end of a fastener 136 (FIG. 3). The grooves 132A and 134A have radii preferably the same as the radius of the rod 120. The fastener 136 includes a turning handle 135 (FIG. 1) and is passed through a hole formed in one of the side plates, through hole 132C of the outer element, and into the threaded bore 134C in the inner element. With the inner element 134 in position with the tab 134B captured in groove 132B, and with the rod 120 inserted between the inner and outer elements in grooves 132A and 134A, as the threaded fastener is turned in a tightening direction, the inner element will be drawn toward the outer element, eventually clamping tightly against the rod 120. The walls of the grooves 132A, 134A form clamping surfaces bearing against the cylindrical surface of the rod. Turning the threaded fastener in a loosening direction will relax the clamping force, permitting the rod to slide freely through the clamp 130.

The locking system is preferably designed to allow the clamp to slip on the rod when in the clamped state in the event of a large force applied to the lifting arm, while providing a braking function slowing movement of the cover. Because of the leverage provided by the arm 70, a large force applied when the clamp is tightened could result in damage to elements of the lifting assembly. Preferably, the clamp is designed to slip when large forces are applied, e.g. due to wind gusts while the cover is in the upright, opened position.

An elastomeric sleeve 128 (FIG. 3) is fitted about the clamp rod 120 to provide a compliant stop to limit the upward travel of the lifting arm. The length of the sleeve is selected to provide a desired stop location. As the lift arm 70 travels upwardly, and the pin 90 slides back toward the side plate end of the apparatus 50, the end of the sleeve will eventually come into contact with the clamp elements 132, 134. The sleeve can be a relatively thick hose or tube of rubber or synthetic elastomeric material. Since the sleeve has limited compressibility in the axial direction, a compliant stop is provided.

The lift arm 70 is formed in this exemplary embodiment as a hollow tubular structure which receives therein in a coupling end an extension arm 140. The extension arm 140 is in turn formed by a second hollow tube of diameter smaller than the coupling end of the lift arm 70. When the spa lifting arms 70 are first coupled to the spa 10 and cover 16, the hollow tubes forming the extension arms 140 are drawn out of the sockets 76 and secured to the cover-engaging and lift grip assembly 150, more particularly shown in FIG. 1, at the end of the cover section 18 at the hinge 21 between the spa cover portions 18 and 20.

Figure 11:
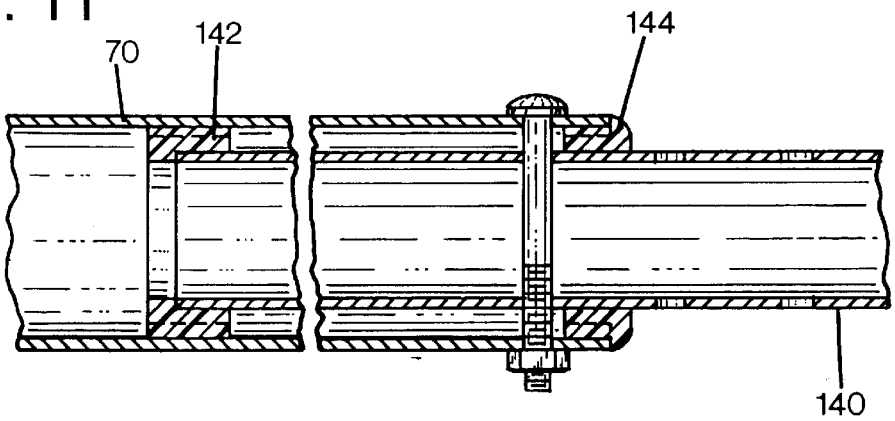
FIG. 11 is a side cross-sectional view of the extension arm 150 engaging in the socket end of the lifting arm 70.

The inner ends of the extension arms 140 that project into the socket ends of the lift arms 70 are provided with annular plastic, injection-molded end caps 142 as shown in FIG. 11. The extension arms 140 are also provided with plastic, injection-molded annular collars 144.

During the initial installation of the cover lifting apparatus, the requisite distance between the pivot point of the lift arm 70 and the cover-engaging end 78 is determined, so that the effective length of the lift arm can be adjusted by positioning the extension arm 140 in the left arm socket 76 to place the cover-engaging end 78 at the appropriate distance from the pivot point. Of course, in an alternate fixed embodiment, the lift arm can be made of a fixed length, with no adjustment in length provided.

Figure 9:
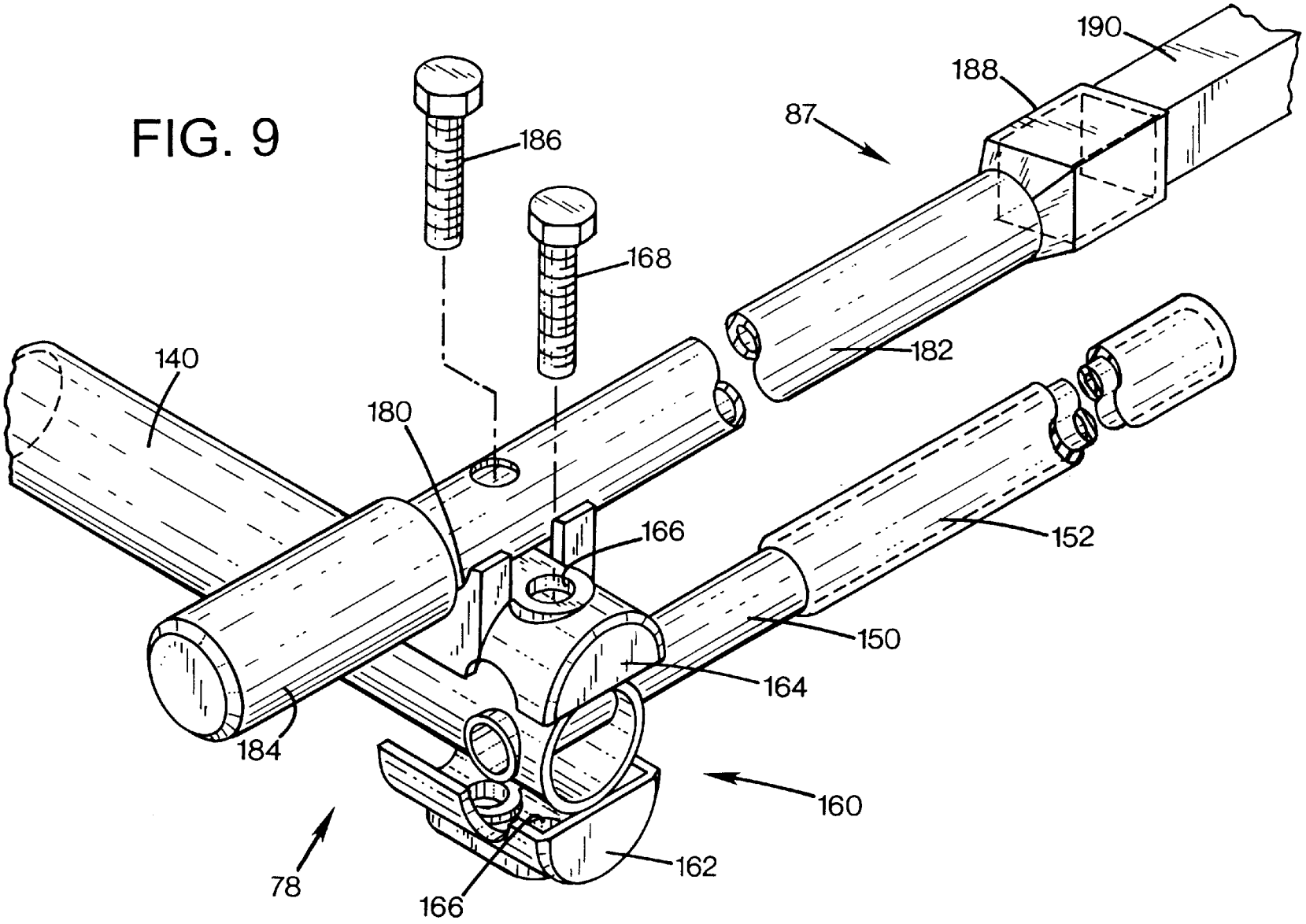
FIG. 9 illustrates in isometric view the cover-engaging end of the lifting apparatus.

FIG. 9 illustrates the cover-engaging end 78 of the lifting apparatus 50. The extension arm 140 has diametrically opposed, transverse, horizontally aligned openings formed therein adjacent the end 78. These opposed openings receive the end of a cylindrical, lower, hinge-engaging bar 150 formed of tubular steel. Each hinge-engaging bar 150 is covered with a padded, vinyl coating 152 where it protrudes inwardly from the cover-engaging end 78 of the lifting arm 70 so as to avoid any puncturing or tearing of the vinyl structure of the cover 16. The lower, hinge-engaging bar 150 of each lifting assembly projects in an inboard direction about seven inches from the cover-engaging end 78 to which it is fastened. Each bar 150 thereby engages the underside of the lateral edges of the hinge 21 of the cover 16.

Each hinge-engaging bar 150 is drilled with diametrically opposed apertures therethrough that are aligned perpendicular to the openings in the cover-engaging end 78 through which the bar 150 extends and is attached. The cover-engaging end 78 is also drilled with a corresponding coaxial set of apertures oriented perpendicular to the apertures that receive the end 78 of the lifting bar 70.

Each end 78 is also provided with a cradle assembly 160 formed by two glass-filled nylon molded component parts 162, 164 that fit together in mating fashion. Both parts 162, 164 include corresponding coaxially-aligned openings 166 that are coaxially aligned with the corresponding diametrically-opposed openings in the cover-engaging end 78 of the lifting arm 70 and the hinge-engaging bar 150. A bolt 168 passing through all of these openings secures the cradle components 162, 164 together and also firmly secures the bar 150 in position projecting inwardly from the cover-engaging end 78 of the lifting arm 70.

The upper cradle component 164 also includes a concave transversely-oriented semicircular saddle 180 formed with a curvature to conform to the outer cylindrical surface of the outboard end of an outboard tube 182 seated thereon. The outboard end of the tube 182 has an enlarged outer diameter and is fitted with a padded handgrip 184 at its extreme outboard extremity. The tube 182 has a pair of drilled opposed apertures that are aligned with corresponding apertures formed through the saddle 180 in the upper cradle 164 and through the cover-engaging end of the extension arm 140, which receive a bolt 186 to secure the tube 182 in position.

Figure 10:
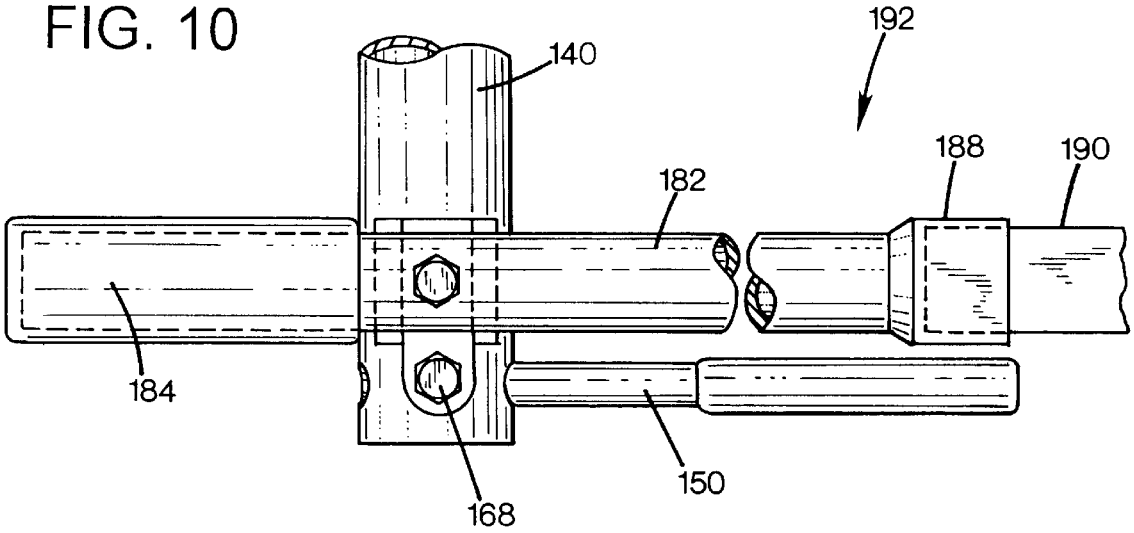
FIG. 10 is a top view of the cover-engaging end and torsion tube employed in the embodiment of FIG. 1.

The outboard tube 182 attached to the lifting arms 70 of each of the lifting assemblies 50 on each side of the spa 10 extends in an inboard direction from the bolts 186 a distance of about thirty-three inches in this exemplary embodiment. As illustrated in FIG. 10, the inboard extremities 188 of the tubes 182 are configured into a square cross section so as to receive therewithin the ends of a torsion tube 190, likewise having a square cross section. The ends of the tube 190 are seated snugly in telescoping fashion within the inboard ends 188 of the tubes 182. The torsion tube 190 has a uniform cross section of one half inch on a side. The tube is three feet in length in a particular exemplary embodiment, but may be cut down in length as necessary to accommodate the width of the spa 10 upon which the lifting apparatus 50 is installed.

Together the pair of outboard tubes 182 and the inboard torsion tube 190 form an upper transverse cover-engaging member 192. When the spa cover 16 is lifted by raising one or the other of the handgrips 184, the upper transverse cover-engaging member 192 ensures that the lifting arm 70 of the other lifting apparatus 50 on the other side of the spa closely follows the movement of the lifting arm 70 at which the opening force is applied.

The cover-engaging ends 78 of the lifting arms 70 and the transverse cover-engaging member 192 are similar in function and structure to that illustrated in applicant's pending application Ser. No. 08/781,804, filed Jan. 10, 1997, "Device For Aiding Removal And Replacement Of A Spa Cover," the entire contents of which are incorporated herein by this reference.

Figure 12:
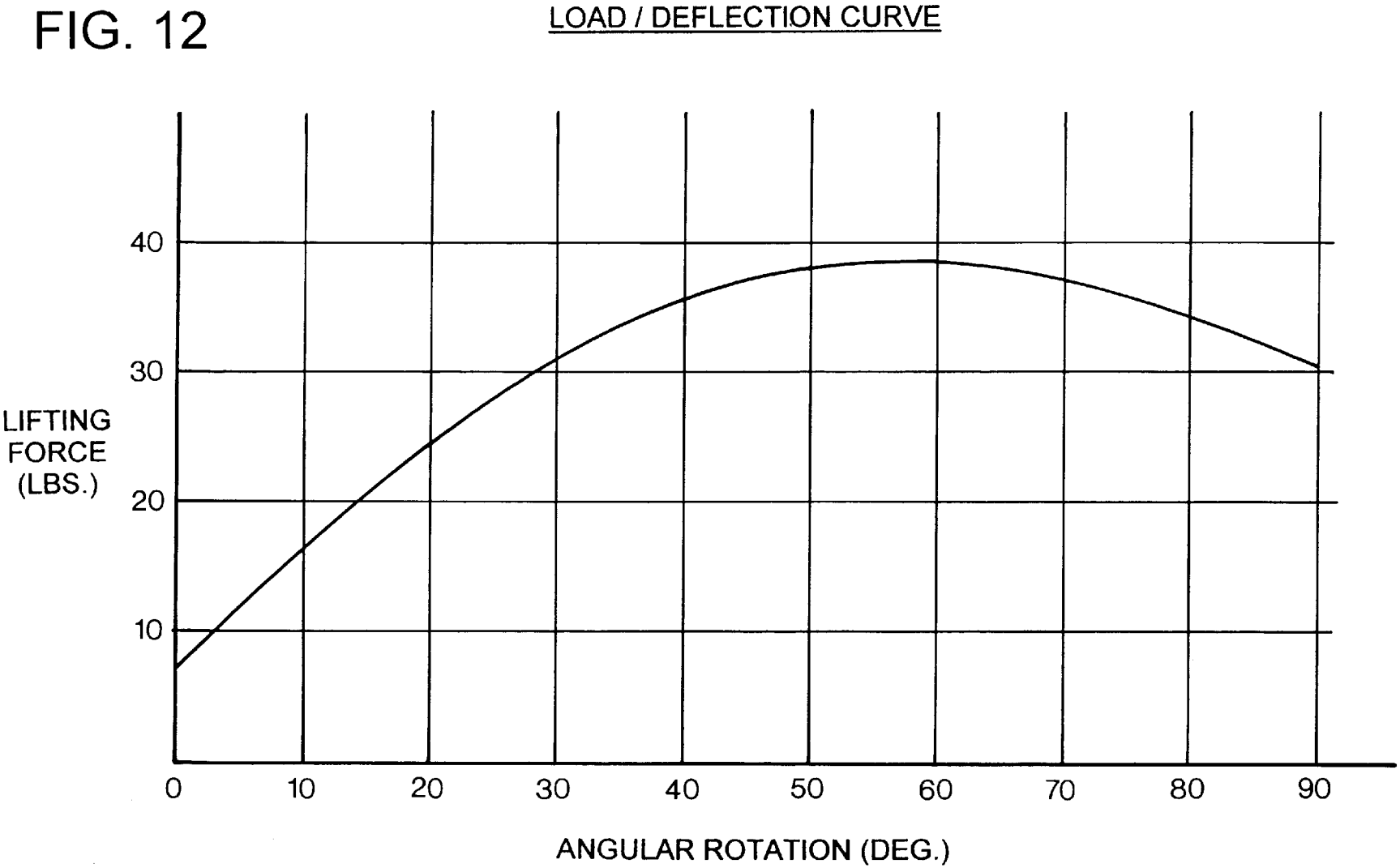
FIG. 12 is a qualitative illustration of the lifting force as a function of angular rotation of the lifting arm from the covering position (at 0 degrees) to the uncovered position (at 90 degrees).

The lifting apparatus 50 in accordance with this invention provides several advantages. When the cover is closed, and the lifting apparatus is in the covering position illustrated in FIG. 1, very little force is being applied by the lifting apparatus in a direction which tends to rotate the cover 16. This results from the connection of the link lever 80 and the spring 52, and from the connection of the pivot end of the lifting arm 70 at a point elevated above the end of the spring 52 connected to the link lever. With the cover in the covering position, the spring 52 is generally parallel to the lifting arm 70. Virtually all of the force being exerted by the compressed spring 52 is directed along or parallel to the axis of the lifting arm 70 at the covering position; only a small force component exists in the vertical direction. As the user pushes upwardly on one of the handles 184 to open the spa cover 16, and the cover rises to a position intermediate the covering position shown in FIG. 1 and the uncovered position shown in FIG. 4, the lifting arm 70 moves away from the link-end of the spring 52, and with the spring force no longer being parallel to the lifting arm, the lifting apparatus transmits a larger biasing force in the vertical direction to assist the cover lifting. This is illustrated graphically in the diagram of FIG. 12, which is a qualitative illustration of the lifting force as a function of angular rotation of the lifting arm from the covering position (at 0 degrees) to the uncovered position (at 90 degrees). As shown therein, the lifting force applied by the lifting arm 70 at the covering position (0 degrees) is relatively small, less than 10 pounds. The lifting force increases as the spa cover is opening, reaching a maximum (almost 40 pounds in this illustration) at a point between 50 and 70 degrees, and diminishes thereafter to match the lifting characteristic desired. (Of course, the particular magnitude of the force will depend on the spring constant of the spring employed in a given embodiment.) The gravitational moment tending to rotate the cover becomes smaller as the cover is rotated toward the uncovered position (90 degrees), since the center of gravity of the cover becomes closer to the center of rotation. To match the reduction in the gravitational moment, the lifting moment of the spring should also be reduced, and this objective is accomplished by the lifting apparatus of this invention.

As a result of the reduced lifting force applied by the apparatus when the cover is in the covering position, one type (spring constant) of spring can be used for a range of applications involving different cover dimensions and weights.

Figure 13:
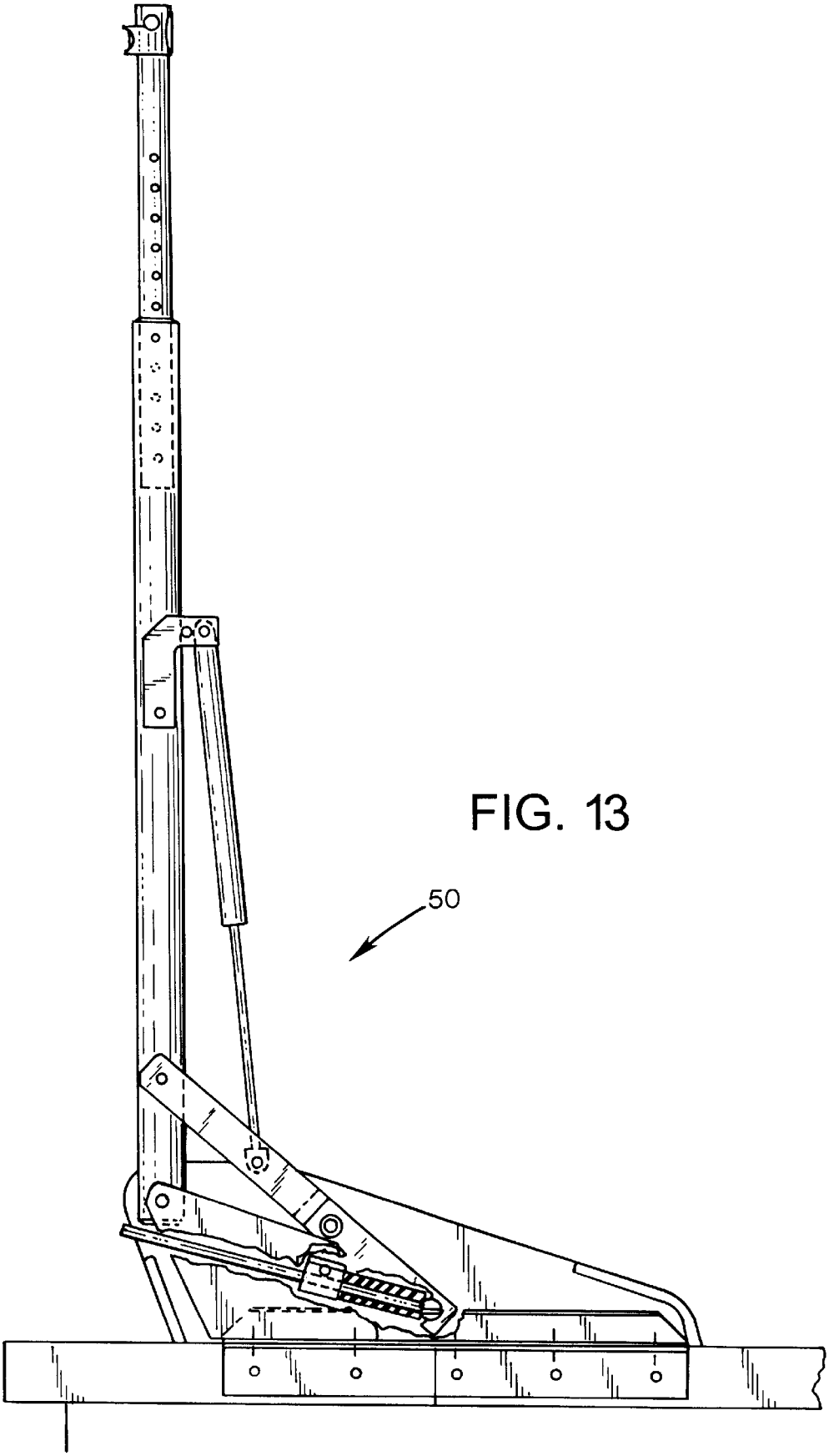
FIG. 13 is a side view showing the lifting assembly in accordance with the invention, with the lifting arm in the upright, uncovered position.
Figure 14:
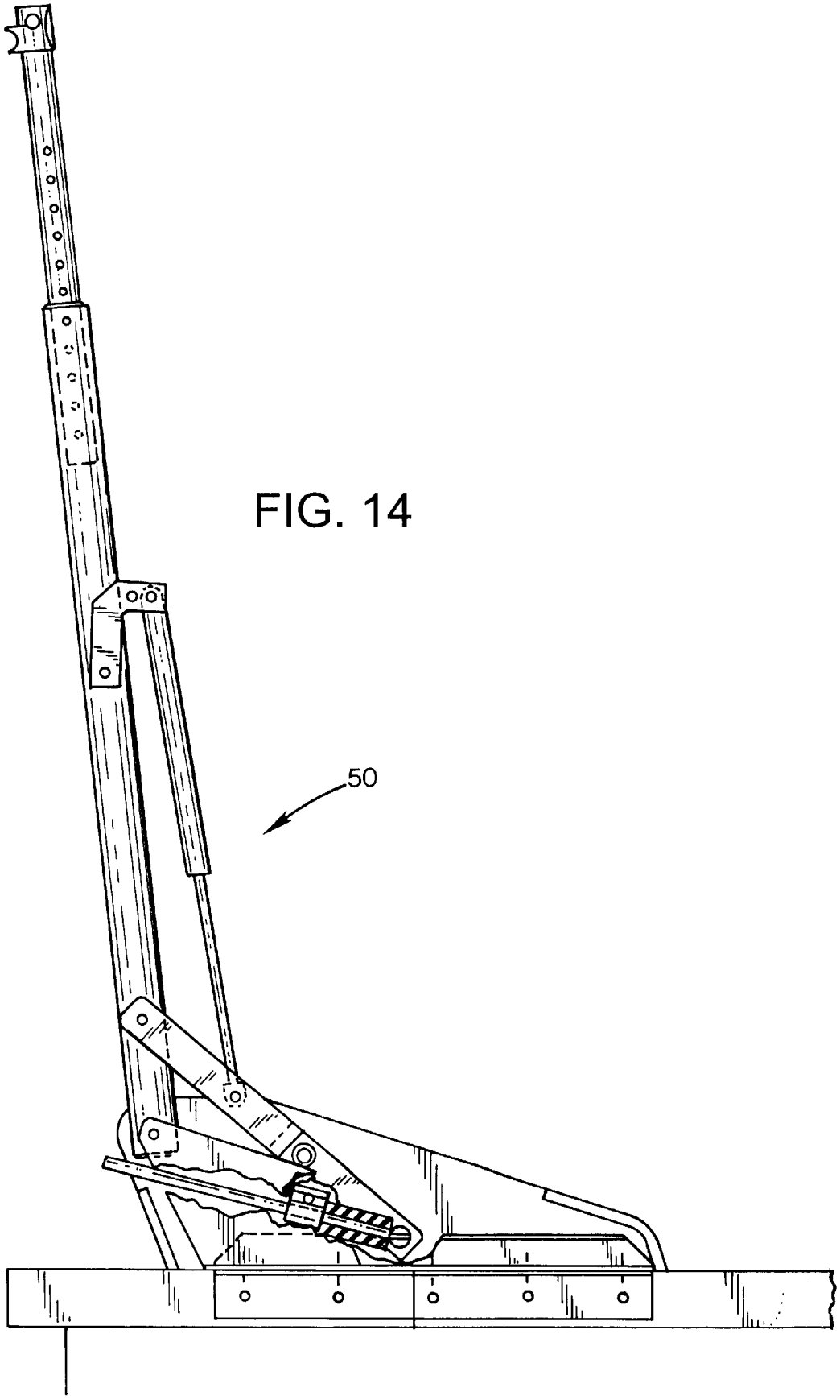
FIG. 14 is similar to FIG. 13, but with lifting arm pivoted slightly past 90 degrees but with a compliant stop in accordance with an aspect of the invention.

Another advantage of the lifting apparatus 50 is provided by the coupling bracket assembly 100. As the cover 16 reaches its uncovered position shown in FIG. 4 with the aid of the lifting apparatus, the cylinder 52 becomes fully extended. This position of the lifting arm 70 is shown in FIG. 13, which omits the spa cover 16 for clarity. If the cover 16 were to continue rotating backwardly as shown to an extent in FIG. 14, e.g. as a result of a wind gust, the gas cylinder could be over-stretched, resulting in damage. However, the bracket assembly 100 prevents over-stretching of the spring, since the link coupling between the piston end and the lifting arm allows the lifting arm 70 to rotate past the vertical position, with the link formed by the bracket 100 rotating to relieve the pulling force on the end of the piston of the gas cylinder.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. Apparatus for aiding removal and replacement of a spa cover on top of a spa tub, said apparatus comprising lifting assemblies adapted to be secured relative to said spa tub, each said lifting assembly comprising:

a lifting arm mounted for rotation relative to said spa tub and including a cover-engaging end adapted to be coupled to the spa cover and a pivot end mounted for pivotal movement about a pivot axis, wherein said lifting arm is rotatable through a range of motion about the pivot axis from a covering position and an uncovering position;

a lifting system for exerting a lifting force on said arm tending to lift said arm as the arm moves from the covering position toward the uncovering position, and for exerting a resistance force on the arm tending to resist movement of the arm from the uncovering position toward the covering position, the lifting system including a force applying structure having a first end coupled to said lifting arm at a location between said arm pivot end and said cover-engaging end, wherein said force applying structure exerts a force substantially parallel with a longitudinal axis of said lifting arm when said lifting arm is in said covering position, so that relatively little force is exerted by the force applying structure in a vertical direction, and wherein as said lifting arm moves from the covering position toward the uncovering position, said force applying structure exerts a force having a substantial force component in the vertical direction, thereby tending to assist in moving the lifting arm to the uncovering position, and wherein said force applying structure has a second end which translates alone a constrained path from a first path location as said lifting arm moves from said covering position to said uncovering position.

2. The apparatus of claim 1 wherein said lifting assemblies include a pair of said lifting assemblies adapted to be located on opposite sides of said spa tub.

3. The apparatus of claim 1 wherein said force applying structure includes a pressurized cylinder and a piston member urged out of said cylinder by gas pressure, and wherein said force applying structure exerts a force along a cylinder axis, and wherein said cylinder axis is substantially parallel to a longitudinal axis of the lifting arm at the covering position, and said cylinder axis is not parallel to said longitudinal axis of said lifting arm at the uncovering position.

4. The apparatus of claim 1 further including a coupling structure for coupling the first end of the force applying structure to the lifting arm, said coupling structure directly transferring force exerted by the force applying structure to the lifting arm when the lifting arm is in the covering position, the coupling structure permitting relative movement between the lifting arm and said first end of the force applying structure as the lifting arm approaches the uncovering position to reduce stresses applied on the force applying structure by the lifting arm in the uncovering position.

5. The apparatus of claim 4 wherein the coupling structure includes a bracket having a first bracket end pivotally connected to said first end of said force applying structure and a second bracket end pivotally connected to said lifting arm.

6. The apparatus of claim 1 further including a clamping system for holding the lifting arm in a desired position.

7. The apparatus of claim 6 further including a compliant stop member for limiting travel of the lifting arm at said uncovered position.

8. The apparatus of claim 1, further comprising, in combination, the spa tub and the spa cover.

9. Apparatus for aiding removal and replacement of a spa cover on top of a spa tub, said apparatus comprising lifting assemblies adapted to be secured relative to said spa tub, each said lifting assembly comprising:

a lifting arm mounted for rotation relative to said spa tub and including a cover-engaging end adapted to be coupled to the spa cover and a pivot end mounted for pivotal movement about a pivot axis, wherein said lifting arm is rotatable through a range of motion about the pivot axis from a covering position and an uncovering position;

a lifting system for exerting a lifting force on said arm tending to lift said arm as the arm moves from the covering position toward the uncovering position, and for exerting a resistance force on the arm tending to resist movement of the arm from the uncovering position toward the covering position, the lifting system including (i) a link lever having a pivot end pivotally mounted to said lifting arm at a link pivot location disposed between said arm pivot end and said cover-engaging end, and a slider end constrained for sliding movement along a slider path of travel, and (ii) a spring structure connected to said link lever at a spring pivot location between said link lever pivot end and said slider end, said spring structure further coupled to said lifting arm at a spring connection point between said arm pivot end and said cover-engaging end, wherein said spring structure is under compression when said lifting arm is at said covering location.

10. The apparatus of claim 9 wherein said lifting assemblies include a pair of said lifting assemblies adapted to be located on opposite sides of said spa tub.

11. The apparatus of claim 9 wherein said slider path is a linear path.

12. The apparatus of claim 9 wherein said spring connection point on said lifting arm is located between said link pivot location and said cover-engaging end.

13. The apparatus of claim 9 further comprising a slider track structure defining said slider path, a slider element constrained for movement along said slider path, said slider element connected to said slider end of said link lever whereby said slider end is constrained for movement along said slider path.

14. The apparatus of claim 13 wherein said slider track structure includes a channel bracket having a pair of aligned walls separated by an open channel, and a pair of edges extending between said walls to define said path.

15. The apparatus of claim 14 wherein said slider element is a pin having slots defined in opposing ends thereof, said edges engaging in corresponding slots of said pin ends.

16. The apparatus of claim 14 further comprising first and second side plates assembled to said channel bracket and extending above said channel bracket, and wherein said pivot end of said lifting arm is secured between said plates for pivotal movement.

17. The apparatus of claim 16 wherein said channel bracket is adapted to be secured at a top edge of said spa tub, and said path is in a generally horizontal position.

18. The apparatus of claim 9 further including a locking system for locking the arm in a desired position.

19. The apparatus of claim 18 wherein said locking system includes a clamp rod having a first end coupled to said link lever and a second end, and a clamp for engaging said rod to hold the rod in a clamped position.

20. The apparatus of claim 19 wherein said clamp includes a first clamp element, a second clamp element, the clamp elements being disposed about the rod such that the rod slides therebetween, and a clamp engager for drawing the second clamp element toward the first clamp element, thereby capturing the rod in said clamped position.

21. The apparatus of claim 20 wherein said clamp engager includes a threaded rod extending through a hole formed in said first clamp element and received in a thread opening formed in said second clamp element, wherein turning the threaded rod in a tightening direction brings the second clamp element toward the first clamp element.

22. The apparatus of claim 19 further including a compliant stop member for limiting travel of the lifting arm at said uncovered position, said stop member including an elastomeric sleeve member disposed about a portion of the clamp rod, wherein an end of said sleeve member comes into contact with said clamp to stop travel of said clamp rod when said lifting arm reaches said uncovered position.

23. The apparatus of claim 9 wherein said spring structure includes a pressurized cylinder and a piston member urged out of said cylinder by gas pressure.

24. The apparatus of claim 9 wherein said spring structure includes:

an elongated spring member having a first end connected to said link lever and a second end; and a coupling structure for coupling the second spring member end to the lifting arm at the spring connection point, said coupling structure directly transferring spring force to the lifting arm from the spring when the lifting arm is in the covering position, the coupling structure permitting relative movement between the lifting arm and said second end of the spring as the lifting arm approaches the uncovering position to reduce stresses applied on the spring by the lifting arm in the uncovering position.

25. The apparatus of claim 24 wherein the coupling structure includes a spring bracket having a first bracket end pivotally connected to said second spring end and a second bracket end pivotally connected to said lifting arm.

26. The apparatus of claim 9, further comprising, in combination, the spa tub and the spa cover.

27. A lifting assembly for applying a lifting force to a pivoting structure, comprising:

a lifting arm including a distal end and a pivot end mounted for pivotal movement about a pivot axis, wherein said lifting arm is rotatable through a range of motion about the pivot axis from a first position and a second position;

a lifting system for exerting a lifting force on said arm tending to lift said arm as the arm moves from the first position toward the second position, and for exerting a resistance force on the arm tending to resist movement of the arm from the second position toward the first position, the lifting system including a force applying structure having a first end coupled to said lifting arm at a location between said arm pivot end and said distal end, wherein said force applying structure exerts a force substantially parallel with a longitudinal axis of said lifting arm when said lifting arm is in said first position, so that relatively little force is exerted by the force applying structure in a vertical direction, and wherein as said lifting arm moves from the first position toward the second position, said force applying structure exerts a force having a substantial force component in the vertical direction, thereby tending to assist in moving the lifting arm to the second position, and wherein said force applying structure has a second end which translates along a constrained path from a first path location as said lifting arm moves from said first position to said second position.

28. A lifting assembly for applying a lifting force to a pivotable structure, comprising:

a lifting arm including a first end and a pivot end mounted for pivotal movement about a pivot axis, wherein said lifting arm is rotatable through a range of motion about the pivot axis from a first position and a second position;

a lifting system for exerting a lifting force on said arm tending to lift said arm as the arm moves from the first position toward the second position, and for exerting a resistance force on the arm tending to resist movement of the arm from the second position toward the first position, the lifting system including (i) a link lever having a pivot end pivotally mounted to said lifting arm at a link pivot location disposed between said arm pivot end and said first end, and a slider end constrained for sliding movement along a slider path of travel, and (ii) a spring structure connected to said link lever at a spring pivot location between said link lever pivot end and said slider end, said spring structure further coupled to said lifting arm at a spring connection point between said arm pivot end and said first end, wherein said spring structure is under compression when said lifting arm is at said first position.

* * * * *